US007264285B1

(12) United States Patent
Ross

(10) Patent No.: US 7,264,285 B1
(45) Date of Patent: Sep. 4, 2007

(54) DEADBOLT SAFETY LATCH

(76) Inventor: Nadine Ross, 25055 Highway 395 North, Kettle Falls, WA (US) 99141

( * ) Notice: Subject to any disclaimer, the term of this patent is extended or adjusted under 35 U.S.C. 154(b) by 0 days.

(21) Appl. No.: 11/641,089

(22) Filed: Dec. 19, 2006

(51) Int. Cl.
*E05C 19/18* (2006.01)
*E05B 3/00* (2006.01)

(52) U.S. Cl. ..... 292/288; 292/348; 24/67.3; 24/67.5; 70/416; 70/447

(58) Field of Classification Search ..... 70/429, 70/447, 416; 292/DIG. 53, DIG. 54, 348, 292/353, 288–289, 303, 256, 258; 24/67.3, 24/67.5, 67.7, 67.9, 67 R; 269/254 R
See application file for complete search history.

(56) References Cited

U.S. PATENT DOCUMENTS 1,004,392 A * 9/1911 Ehrlich et al. ..... 224/248
1,761,131 A * 6/1930 Kupfer ..... 70/429
2,942,905 A * 6/1960 Wootton ..... 292/17
3,640,519 A * 2/1972 Halstead ..... 269/254 R
3,862,556 A * 1/1975 Moses ..... 70/416
3,933,014 A * 1/1976 Moses ..... 70/416
4,902,078 A * 2/1990 Judd ..... 312/7.2
5,000,498 A * 3/1991 Upchurch ..... 292/288
5,369,971 A * 12/1994 Sheppard ..... 70/416
5,950,283 A * 9/1999 Sato ..... 24/67 R

* cited by examiner

*Primary Examiner*—Brian Glessner
*Assistant Examiner*—Alyson M. Merlino
(74) *Attorney, Agent, or Firm*—Keith S. Bergman; William A. Jeckle

(57) ABSTRACT

A dead-bolt lock safety latch for preventing unauthorized unlocking of a dead-bolt lock with a key or lock picking tools provides a spring biased body having two legs, each leg having a leg extension, and carrying an elongate handle to provide mechanical leverage to temporarily overcome spring biasing of the body for moving the leg extensions away from one another for releasable engageable with a base portion of a dead bolt lock carried by a door. Protrusions on the leg extensions engage with diametrically opposed notches defined in a base portion of the deadbolt lock while deadbolt knob is positionally maintained in a medial space between the legs to prevent rotation thereof.

4 Claims, 1 Drawing Sheet

DEADBOLT SAFETY LATCH

BACKGROUND OF INVENTION

1. Related Applications

There are no applications related hereto heretofore filed in this or in any foreign country.

2. Field of Invention

This invention relates to locks, and more particularly to tampering prevention mechanisms for deadbolt locks.

BACKGROUND AND DESCRIPTION OF PRIOR ART

Deadbolt locks are among the most effective and reliable forms of door locks. A typical deadbolt lock has a bolt which communicates with a key turning apparatus, on an exterior door side, and with a deadbolt knob on the interior door side. A person inside the door engages and disengages the bolt by turning the knob while a person on the outside of the door can only in engage and disengage the bolt with the key.

The knob, the keyhole apparatus and the bolt are operatively interconnected in such a manner that if the bolt is operated with the key from the outside, this action will necessarily result in the knob turning with the motion of the bolt. Accordingly, if the knob is physically immobilized so that it cannot be turned, the key apparatus is rendered inoperable and the bolt cannot be moved.

Mass produced commercially available deadbolt locks may be adapted to be operated with a common master key. In such circumstances anyone having possession of the master key is able to enter any of the residences protected by the corresponding deadbolt lock. Additionally, there are those persons who are adept at picking locks open without the key using "lock picking tools". Unauthorized entry may result in the interruption of an individual's privacy and present other personal dangers. It is therefore necessary to provide some means to prevent the unauthorized opening of deadbolts with unauthorized keys and with lock picking tools.

While a number of devices have been developed to accomplish this task, there are drawbacks to each of them including the complexity of such devices and the permanency of mounting requirements.

My invention overcomes various of the above-mentioned drawbacks by providing a spring biased clamp body that may be temporarily installed upon interior portion of a deadbolt lock that immobilizes the knob and renders the keyhole apparatus inoperable. My invention has two opposing protrusions that releasably engage with diametrically opposed notches defined in a deadbolt base, and a medial space between the protuberances that is positioned about the deadbolt knob to prevent rotation thereof which correspondingly immobilizes the keyhole apparatus and the bolt.

My invention does not reside in any one of the identified features individually but rather in the synergistic combination of all of its structures, which give rise to the functions necessarily flowing therefrom as hereinafter specified and claimed.

SUMMARY

My dead-bolt safety latch for preventing unauthorized unlocking of a deadbolt lock provides a spring steel body having a back with opposing edge portions carrying legs that extend convergingly from the back and define a medial space therebetween. Leg extensions, each having a "C" bend forming a first radial portion, a second vertical portion, a third radial portion and a notch engaging protrusion interconnect with an edge portion of each leg opposite the back. Each notch engaging protrusion is carried at an edge portion of the third radial portion and releasably engages with one of two diametrically opposed notches defined in a base portion of the deadbolt lock. Elongate handles pivotally interconnected to each leg of the body are used to overcome the spring biasing of the body to install and remove the deadbolt safety latch upon a deadbolt base.

In providing such an apparatus it is:

a principle object is to provide a deadbolt safety latch that prevents unauthorized opening of a deadbolt lock mechanism with a key.

a further object to provide such a deadbolt safety latch that immobilizes the deadbolt knob and the deadbolt lock.

a further object to provide such a deadbolt safety latch that prevents opening of a deadbolt lock mechanism with lock picking tools.

a further object to provide such a deadbolt safety latch that may be installed on an existing deadbolt.

a further object to provide such a deadbolt safety latch that cannot be tampered with nor detected from outside of the door.

a further object to provide such a deadbolt safety latch that is easily installed and easily removed.

a further object to provide such a deadbolt safety latch that is simple to operate.

a still further object to provide such a deadbolt safety latch wherein the positional maintenance of the safety latch preventing rotation of the deadbolt knob cannot be overcome by a turning force applied to the keyhole apparatus by means of a key or lock picking tools.

a still further object to provide such a dead-bolt safety latch that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 3:
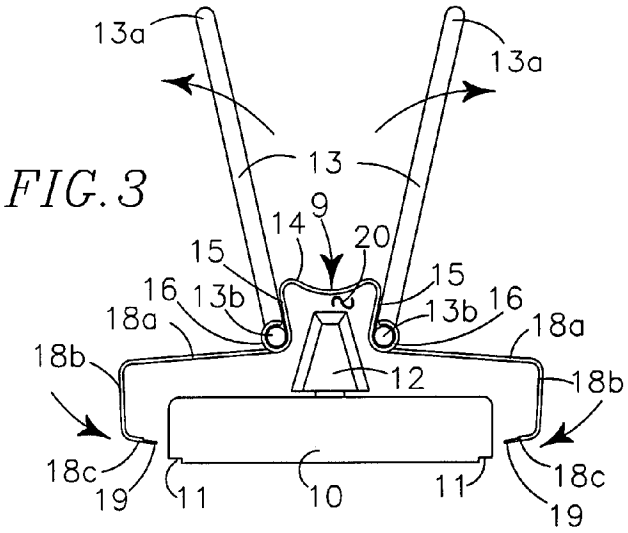
FIG. 3 is an orthographic view of the deadbolt safety latch adjacent above a deadbolt base and knob showing the handles moving away from one another and the relative movement of the leg extensions as indicated by the arrows.

As used herein, the term "outer", its derivatives and grammatical equivalents refers to a portion of the deadbolt safety latch that is distal from a laterally medial portion of the deadbolt safety latch.

My deadbolt safety latch generally provides a body 9 having two spaced apart opposing legs 15 defining a medial space 20 therebetween, each leg 15 carrying a pivotally attached elongate handle 13.

The body 9 is formed of a single piece of spring steel having a back 14 carrying legs 15 at opposing elongate edge portions. Medial space 20 is defined between the two opposing legs 15 and adjacent the back 14 so that the body 9 fits over and about deadbolt knob 12. Handle axle channels 16 are formed into each leg 15 at edge portions opposite the back 14 by rolling the edge portion outwardly and upwardly into a substantially tubular channel.

The two legs 15 extend from opposing edge portions of the back 14 and converge inwardly. A leg extension 18 is carried by each leg 15 at an edge portion opposite the back 14 and each leg extension 18 has a "C" bend shape forming a first radial portion 18*a*, a second vertical portion 18*b*, a third radial portion 18*c* and a notch engaging protrusion 19. The first radially extending portion 18*a* extends outwardly from the leg 15 opposite from and generally parallel to the back 14. The second vertical portion 18*b* extends generally perpendicular to the back 14 and is carried opposite the leg 15. The third radial portion 18*c* is generally parallel to the first radial portion 18*a* extending inwardly toward the medial space 20 and is carried opposite the first radial portion 18*a*. The notch engaging protrusion 19 is carried at an edge portion of each third radial portion 18*c*, opposite the second vertical portion 18*b*, for releasable engagement with a notch 111 defined in the deadbolt base 10.

Figure 2:
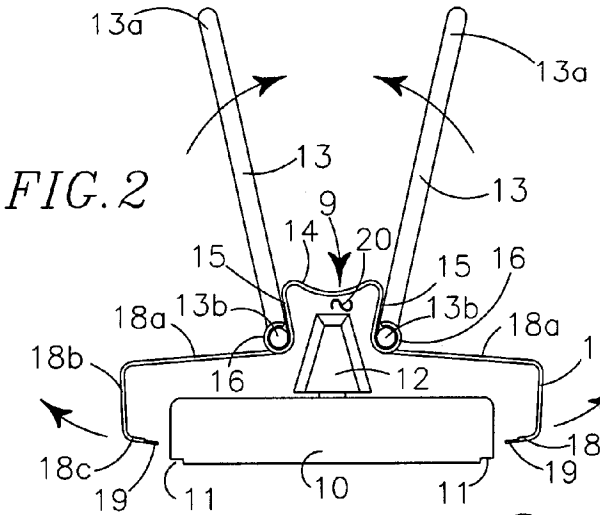
FIG. 2 is an orthographic view of the deadbolt safety latch adjacent above a deadbolt base and knob showing the handles being squeezed together and the relative movement of the leg extensions, as indicated by the arrows.
Figure 1:
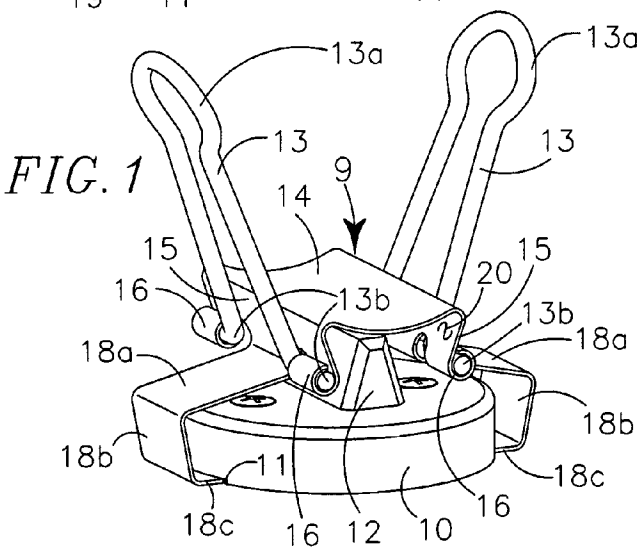
FIG. 1 is an isometric view of my deadbolt safety latch installed on a deadbolt lock mechanism showing the notch engaging protrusions engaged with notches defined in a base portion and the deadbolt knob within the medial space.

Elongate handles 13 each having a looped portion 13*a* and two opposed spaced apart axles 13*b* are used to mechanically overcome the spring biasing of the body 9. The axles 13*b* engage with and are carried within the handle axle channels 16 formed into the legs 15 adjacent the leg extensions 18 and opposite the back 14. The triangular configuration of the body 9 (See FIG. 4) formed by the back 14 and the inwardly converging legs 15, and the position of the handle axle channels 16 relative thereto causes the handles 13 to diverge outwardly relative to the back 14 causing the looped portions 13*a* of handles 13 to be spaced apart. The position of the back 14 relative to the handles 13 and to the axles 13*b* in the axle channels 16 creates a fulcrum or pivot point about which mechanical leverage is applied to the legs 15 and leg extensions 18 when the looped portions 13*a* of the handles 13 are squeezed together by an operator. (FIG. 2). When the looped portions 13*a* are squeezed together the notch engaging protrusions 19 are moved away from one another allowing the safety latch to be engaged with, or disengaged from, the deadbolt base 10.

Having described the structure of my deadbolt safety latch, its operation may be understood.

The deadbolt base 10 must be modified for use of the instant deadbolt safety latch. The deadbolt knob 12, which is commonly rectilinear having a major dimensional axis and a minor dimensional axis, is rotated into a locked position so that the bolt (not shown) carried within the locking mechanism is extended to engage with an adjacent doorjam (not shown). While the deadbolt knob 12 is in this locked orientation, the user marks the deadbolt base 10 with a pencil, or other suitable marking device, at two diametrically opposed positions one on each side of the deadbolt knob 12 aligned with a line extending through the minor dimensional axis of the knob 12. The deadbolt locking mechanism is removed from the door pursuant to manufacture's instructions so the deadbolt base 10 may be modified. Rectilinear notches 11 are formed into in the edge portion of the base 10 at the locations of the previously made marks. It is preferable each notch 11 have dimensions of approximately ⅜ inch long by ⅛ inch high for engagement with the notch engaging protrusions 19 of the leg extensions 18. The notches may be formed by any appropriate means such as with a file, a drill or a grinder. The locking mechanism and base 10 are reinstalled on the door pursuant to installation instructions. When reinstalled, the deadbolt base 10 should be aligned so that the notches 11 defined in the edge portions thereof are aligned with the minor dimensional axis of the deadbolt knob 12 when the deadbolt knob 12 is in the locked position.

As shown in FIG. 2, the body 9 of the deadbolt safety latch is opened by a user applying squeezing pressure to the looped portions 13*a* of the opposing handles 13 which responsively causes the leg extensions 18 and the notch engaging protrusions 19 thereon to move outwardly. (The arrows of FIG. 2, show the direction of movement).

As shown in FIG. 3, once the body 9 has been positioned over and about the deadbolt base 10 and the deadbolt knob 12 the squeezing pressure on the looped portions 13*a* of the handles 13 is released and the spring biasing of the body 9 contracts the leg extensions 18 causing the notch engaging protrusions 19 to engage with the notches 11 defined in the deadbolt base 10. (The arrows of FIG. 3, show the direction of movement).

Figure 4:
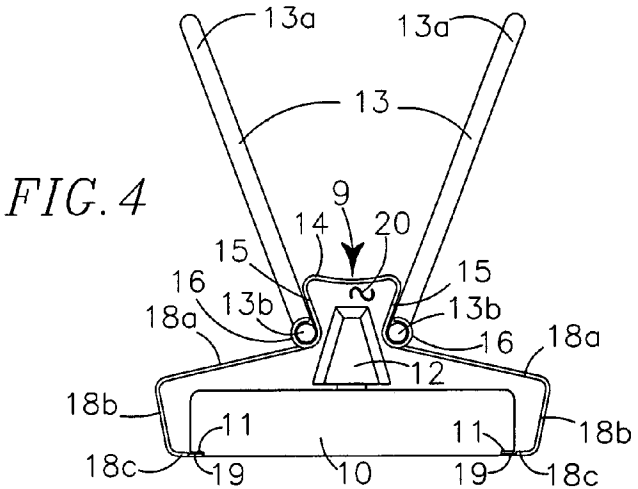
FIG. 4 is an orthographic view showing the deadbolt safety latch installed on the deadbolt base and the deadbolt knob within the medial space.

As shown in FIG. 4, the deadbolt safety latch is installed on the deadbolt base 10 and the notch engaging protrusions 19 are engaged with the diametrically opposed notches 11 defined in the deadbolt base 10. The deadbolt knob 12 is positionally maintained in the medial space 20 between the legs 15 and adjacent the back 14 of the body 9. The medial space 20 between the legs 15 is too narrow to permit rotation of the deadbolt knob 12. This configuration prevents the deadbolt from being operated with a key or with lock picking tools from the outside of the door until the deadbolt safety latch is disengaged from the deadbolt base 10.

The foregoing description of my invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and

I claim:

1. A deadbolt safety latch in combination with a deadbolt lock for preventing unlocking of the deadbolt lock with the deadbolt lock having an outside portion and an inside portion and a locking mechanism operatively interconnecting the outside portion to the inside portion wherein a key inserted into and rotated in an orifice defined in the outside portion operates the locking mechanism and rotates a deadbolt knob having a major dimensional axis and a minor dimensional axis carried adjacent a deadbolt base on the inside portion, the deadbolt safety latch comprising:

a spring biased body having retentive memory and a back with opposing elongate edge portions;

a leg extending angularly from each elongate edge portion, the legs defining a medial space therebetween;

a leg extension interconnected with an edge portion of each leg opposite the back, each leg extension having, a first radial portion extending away from the medial space and substantially parallel to the back, a second vertical portion interconnected with the first radial portion opposite the leg extending away from the back and substantially parallel to the leg, a third radial portion interconnected the second vertical portion opposite the first radial portion extending toward the medial space and substantially parallel to the first radial portion, and a protrusion extending from an edge portion of the third radial portion opposite the second vertical portion for releasable engagement with one of two diametrically opposed notches defined in the deadbolt base; and an elongate handle interconnected to each leg adjacent the edge portion carrying the first radial portion of the leg extension for temporarily overcoming the spring bias of the body causing the protrusions to move laterally away from one another.

2. The deadbolt safety latch of claim 1 wherein: the body is formed of spring steel.

3. The deadbolt safety latch of claim 1 further comprising: a handle axle channel at an edge portion of each leg opposite the back, the handle axle channel communicating with an axle carried by each handle.

4. The deadbolt safety latch of claim 1 wherein: the medial space between the legs and adjacent the back is sized to accommodate therein the deadbolt knob and prevent rotation of the deadbolt knob while accommodated therein.

* * * * *